US007083734B2

(12) United States Patent
Happonen

(10) Patent No.: US 7,083,734 B2
(45) Date of Patent: Aug. 1, 2006

(54) METHOD AND APPARATUS FOR CLEANING A WATER AREA

(76) Inventor: Antti Happonen, Rihmakuja 6, FIN-04230 Kerava (FI)

( * ) Notice: Subject to any disclaimer, the term of this patent is extended or adjusted under 35 U.S.C. 154(b) by 0 days.

(21) Appl. No.: 10/484,905

(22) PCT Filed: Jul. 17, 2002

(86) PCT No.: PCT/FI02/00639

§ 371 (c)(1),
(2), (4) Date: Mar. 26, 2004

(87) PCT Pub. No.: WO03/010388

PCT Pub. Date: Feb. 6, 2003

(65) Prior Publication Data

US 2004/0159614 A1 Aug. 19, 2004

(30) Foreign Application Priority Data

Jul. 27, 2001 (FI) ..... 20011581

(51) Int. Cl.
*B01D 21/00* (2006.01)

(52) U.S. Cl. ..... 210/747; 210/800; 210/170; 210/532.1; 37/320; 37/326

(58) Field of Classification Search ..... 210/747, 210/170, 800, 801, 521, 532.1; 37/317, 320, 37/326, 329

See application file for complete search history.

(56) References Cited

U.S. PATENT DOCUMENTS

| | | | | |
|---|---|---|---|---|
| 866,094 | A * | 9/1907 | Vial | 210/532.1 |
| 1,611,478 | A * | 12/1926 | Massey | 37/320 |
| 4,004,357 | A * | 1/1977 | Faldi | 37/320 |
| 4,053,181 | A * | 10/1977 | Saito | 37/329 |
| 4,146,982 | A * | 4/1979 | Norisugi | 37/326 |
| 4,264,105 | A | 4/1981 | Thompson | |
| 4,267,652 | A * | 5/1981 | Senesac | 37/329 |
| 4,398,362 | A | 8/1983 | Weinert | |
| 4,685,742 | A | 8/1987 | Moreau | |
| 4,807,373 | A * | 2/1989 | Sloan et al. | 210/170 |
| 5,203,099 | A * | 4/1993 | Naranjo et al. | 37/317 |
| 5,575,921 | A | 11/1996 | Askin et al. | |
| 5,584,993 | A * | 12/1996 | Van Der Schrieck | 210/170 |
| 6,099,743 | A * | 8/2000 | Pedersen | 210/521 |
| 6,178,670 | B1 | 1/2001 | Susman et al. | |
| 6,550,162 | B1 * | 4/2003 | Price et al. | 37/317 |

FOREIGN PATENT DOCUMENTS

| | | |
|---|---|---|
| FI | 892157 A | 11/1990 |
| SE | 381483 B | 12/1975 |

* cited by examiner

*Primary Examiner*—Christopher Upton
(74) *Attorney, Agent, or Firm*—Birch, Stewart, Kolasch & Birch, LLP

(57) ABSTRACT

A method for cleaning a water area including dredging, via a dredging apparatus, waste from the water area through a suction pipe into a sedimentation basin, generating a flow of the dredged waste from the water area to the sedimentation basin via siphonage and variations in heights of the suction pipe relative to a bottom of the water area, and converting energy caused by the flow of the dredged waste in the suction pipe into energy for driving the dredging apparatus.

20 Claims, 6 Drawing Sheets

METHOD AND APPARATUS FOR CLEANING A WATER AREA

This application is a national phase of PCT International Application No. PCT/FI02/00639 filed on Jul. 17, 2002 under 35 U.S.C. § 371. This application also claims priority of Application No. 20011581 filed in Finland on Jul. 27, 2001 under 35 U.S.C. § 119. The entire contents of each of the above-identified applications are hereby incorporated by reference.

BACKGROUND OF THE INVENTION

Field of the Invention

The present invention relates to a method for cleaning a water area, such as a lake, pond, river or a similar water basin. The invention also concerns an apparatus for cleaning a water area, such as a lake, pond, river or a similar water basin.

At present, dredging and cleaning of water basins are carried out using conventional machinery in which the drive engines are usually petrol-fuelled internal combustion engines. However, internal combustion engines consume fuel and pollute the air as well as water basins. Moreover, such engines are relatively noisy.

SUMMARY OF THE INVENTION

The object of the present invention is to eliminate the drawbacks of prior art and to achieve a completely new type of system for creating dredging and cleaning equipment and equivalent for use in water basins.

In the system of the invention, the sludge and other residuals produced in connection with dredging and water purification can be removed from the lake via the same suction tube, a so-called "single-pipe system".

In the system of the invention, a dredging apparatus is used for cleaning the bottom of a lake to remove excessive humus and undesirable fine-grained sediment, which have been partly produced from waste water emissions in the course of decades. Reducing the amount of nutrients dissolved in the water contributes towards improving the natural oxygen situation in the water and promoting the well-being of the biological population.

The cleaning is implemented by utilizing an environmentally friendly and energy-economical dredging apparatus, by means of which the sludge is conveyed via a feeble-constructed plastic discharge pipe into a sedimentation basin. The water separated is finally filtered and passed via an open drain into a natural ditch.

The dredging apparatus is very energy-economical and almost completely nonpolluting as compared with current methods. A further advantage of the system can be seen in the fact that the lake side remains intact as the system does not disturb or damage the environment because the dredgings are passed into a sedimentation basin located at a distance from the lake side area. The cleaning of a lake can be performed even including the shallow coastal waters and grassy areas. Neither do depth variations in the water area impede the use of the equipment. The sedimentation basin is built in a chosen location by making use of natural banks so that no actual construction materials are needed, and the land area in question can be restored after use to its original form.

After final filtering, the water separated from the sedimentation basin is passed in a purified state into the inflow ditch. The humus and sludge carried into the sedimentation basin are composted within the basin area and dried and processed further, to be reused as fertilizer and soil conditioner.

By applying the invention, a very environmentally friendly and reliable system for use as a cleaning apparatus in a water area is achieved. The dredging of the material to be actually dredged is performed without mechanical loading and transportation.

BRIEF DESCRIPTION OF THE DRAWINGS

In the following, the invention will be described in greater detail by the aid of an example with reference to the attached drawings, wherein.

DETAILED DESCRIPTION OF THE PREFERRED EMBODIMENTS

EXAMPLE 1

Figure 1:
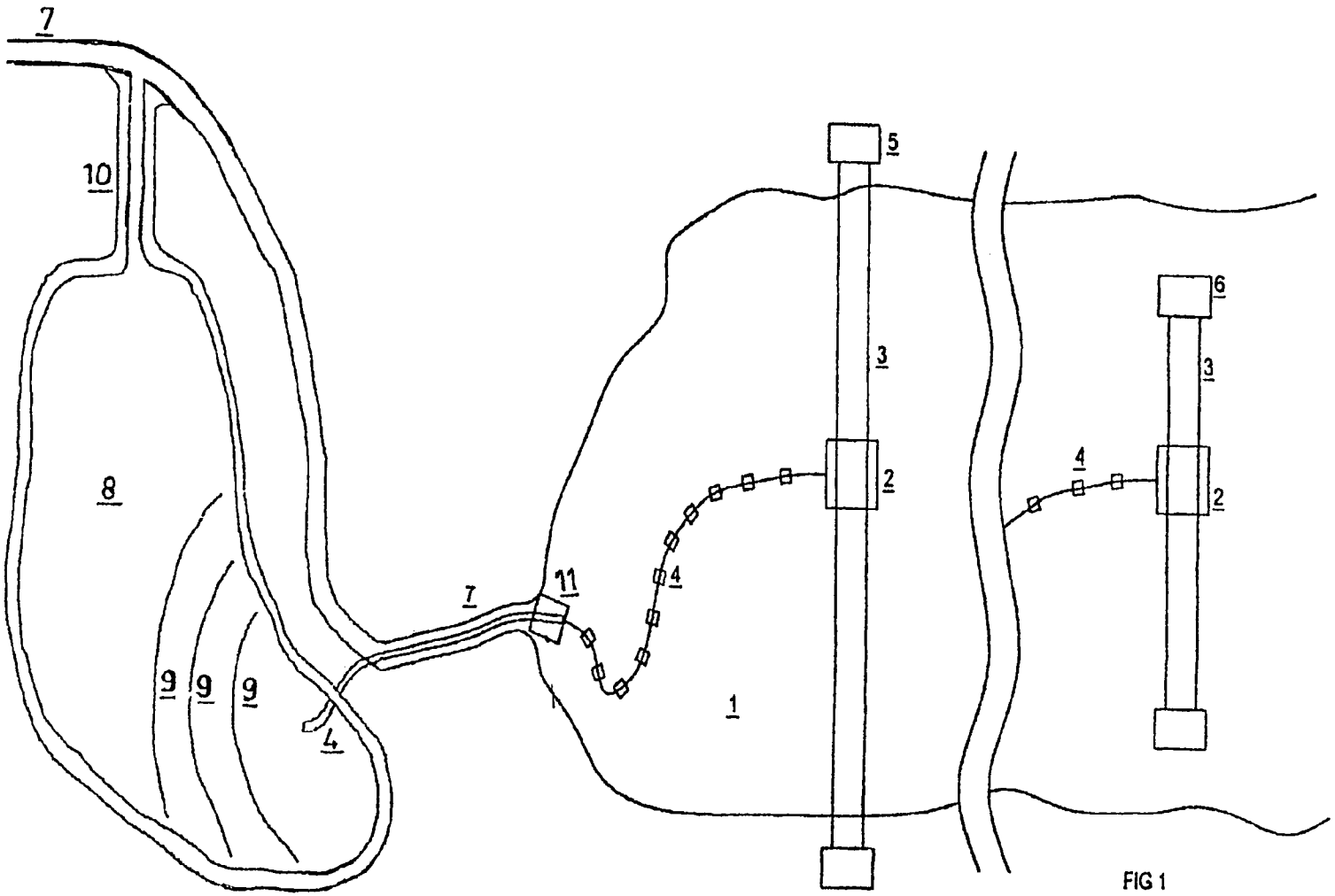
FIG. 1 presents dredging equipment according to the invention, moving on a lake.

FIG. 1 shows dredging systems according to the invention for dredging a lake 1, which comprise a floating operating carriage 2 serving as a kind of ferry supporting the dredging apparatus, guide cables 3 for guiding it, a suction pipe 4 leading to an inflow ditch 7 of the lake or by some other route to a sedimentation area situated at a lower altitude, and coastal vessels 5 or control ferries 6, by means of which the motion of the operating carriage is controlled.

According to the invention, the suction pipe 4 leads into the sedimentation basin 8 located at a lower level. The invention is used to remove the light nutrient organic layer of nutrients and humus from the area of the lake system. By means of the apparatus, light nutrient humus is taken away from the water area (lake) via the piping system 4 into the sedimentation basin 8 located at a lower level and clarified there by reducing the flow rate so that the flow in the discharge area of the pipe 4 in the sedimentation basin 8 is spread over an area (typically 10–50 times) wider than the suction area at the beginning of the pipe. In addition, the flow can be controlled by means of boom elements 9 provided in the basin 8. The mass removed from the lake by suction is deposited, restoring its original form, and the purified water is passed via an exit ditch 10 back into the inflow ditch 7. The end of the discharge pipe 4 is placed below the water surface in the mudflow basin or choked so that no air can enter into the pipe.

Some or all of the operating energy needed in the process is obtained from a suction turbine which is connected between the upper end of the suction pipe and the dredging apparatus and which utilizes the water flow occurring by siphonage in the suction pipe 4 and the movement of the mass mixed in it. It is also possible to use an external energy source.

Figure 2:
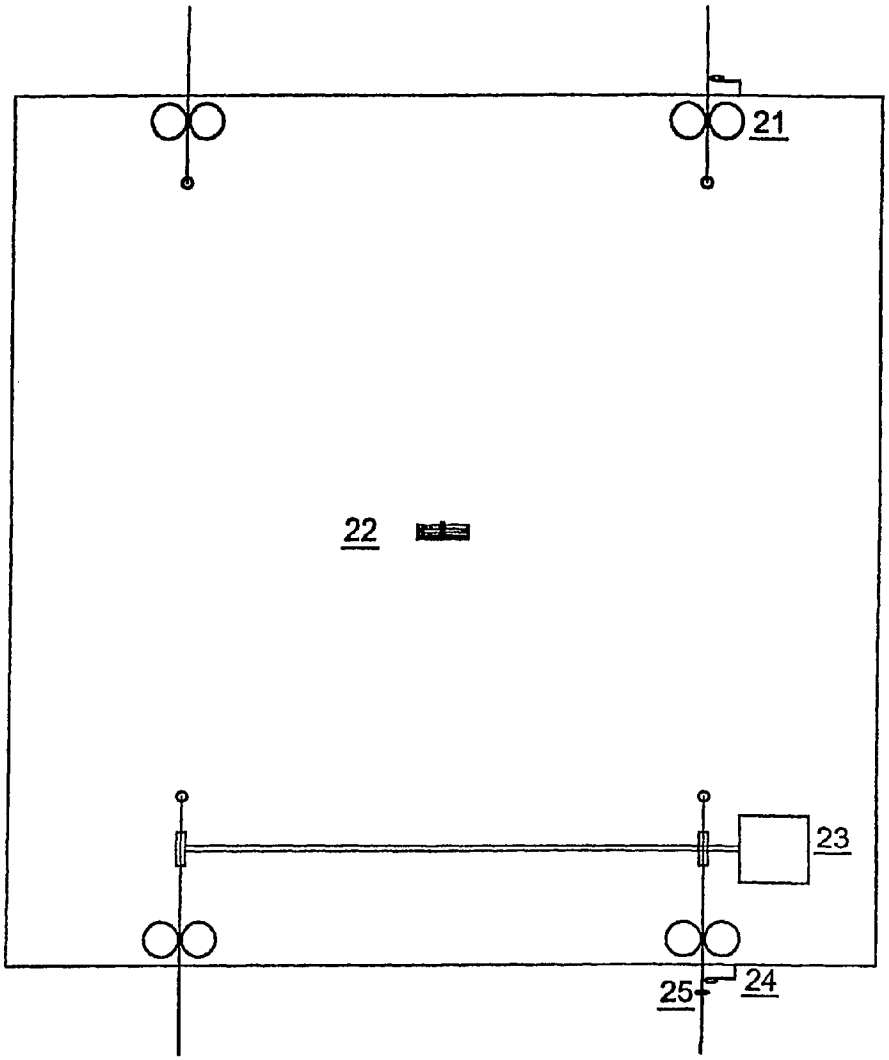
FIG. 2 presents the floating operating carriage of a dredging apparatus.

The floating operating carriage presented in FIG. 2 comprises cable guides 21, counterweight supporting cables 22 and a water hydraulic motor 23 for cable drive. In addition, it may be provided with a reversing switch 24 for the water hydraulic motor and a control stopper 25 attached to the cable.

Figure 3:
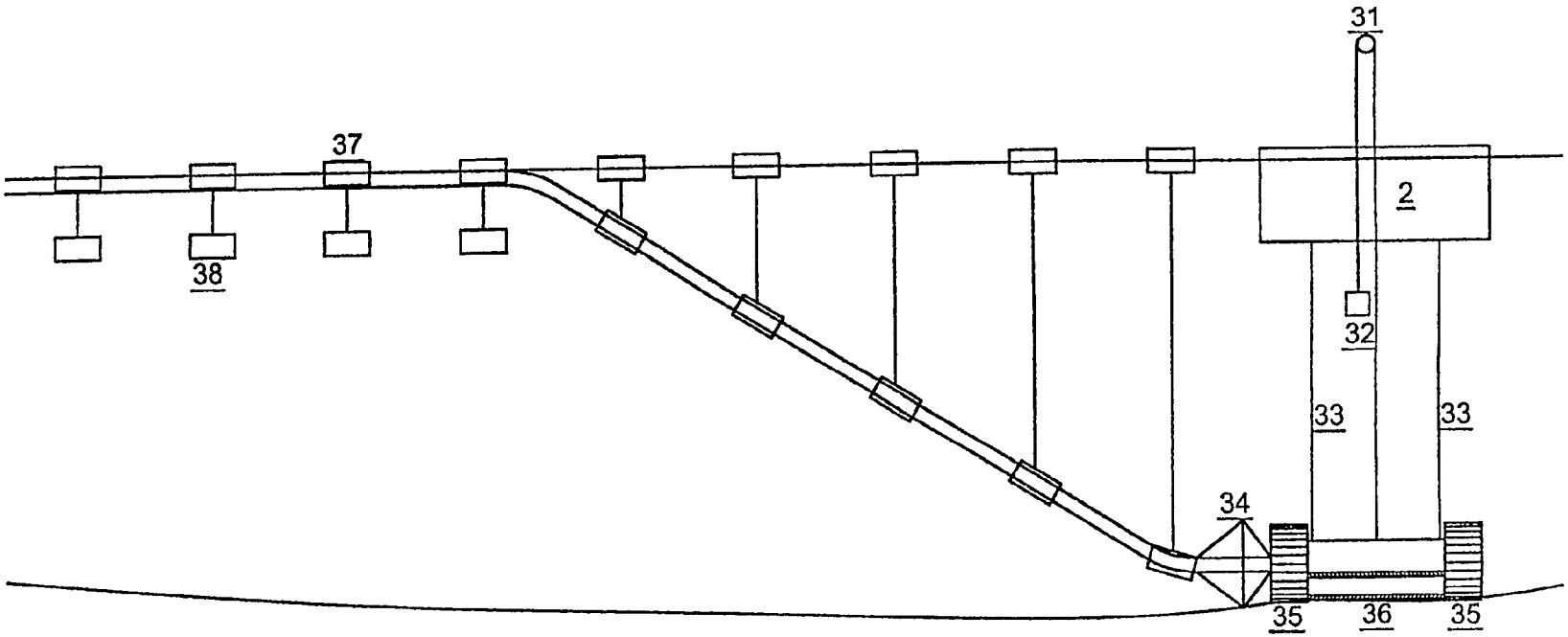
FIG. 3 presents a side view of the dredging apparatus of the invention.

As shown in FIG. 3, the dredging apparatus comprises a supporting/lightening backstay wire rope 31 connected to a floating supporting/operating carriage and provided with a counterweight 32, as well as operating wire cables 33 for steering right and left. The dredging apparatus moves along the bottom, and it comprises a suction turbine 34, propulsion rollers 35 fitted on a frame and milling/feed rollers 36. The suction pipe is supported by supporting floats 37, and additionally stabilizing weights 38 are provided.

Figure 4:
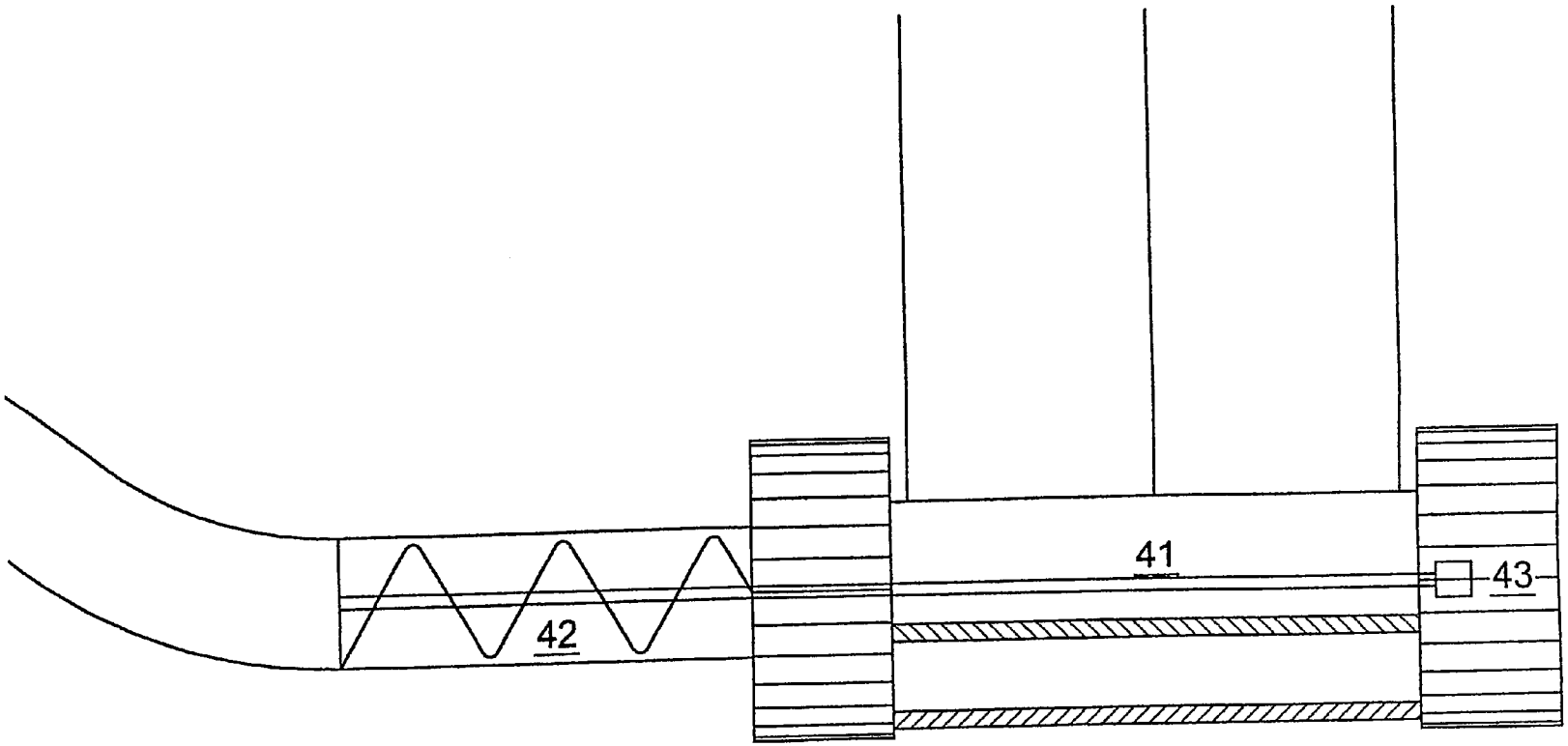
FIG. 4 presents a suction turbine at the end of a suction pipe.

As shown in FIG. 4. the suction turbine 34 has a main drive shaft 41 and a turbine blade part 42, both connected to the end of the suction pipe. Connected after the turbine is a water hydraulic pump 43 for operating the propulsion rollers and transfer cable etc.

Figure 5:
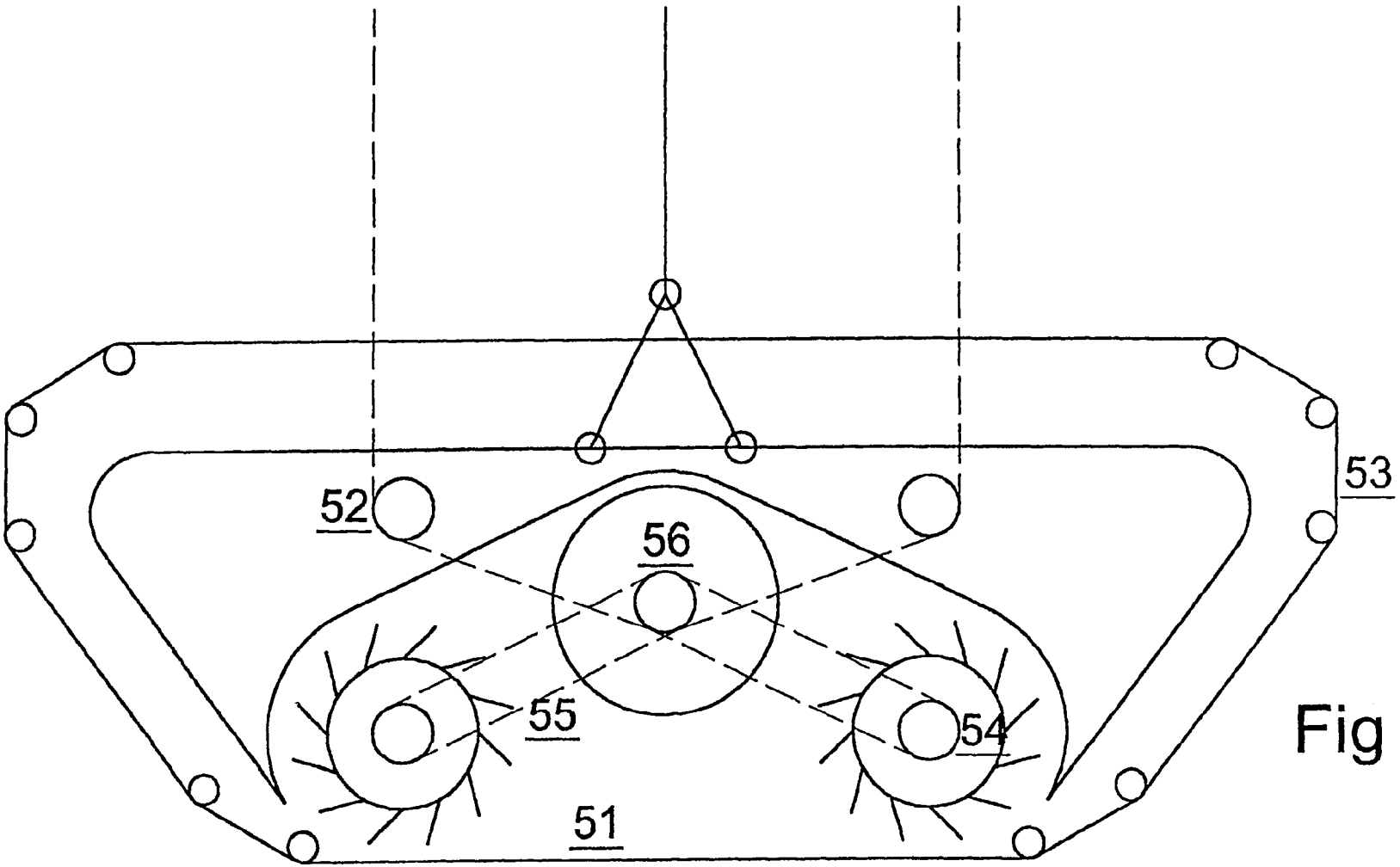
FIG. 5 presents a more detailed view of the dredging apparatus.

As shown in FIG. 5, the actual dredging apparatus consists of a frame 51, guide rollers 52 for the drive cable, a caterpillar drive roller 53, and milling feed rollers 54 (front and rear) driven e.g. by means of a cogged rubber belt 55 by a main shaft 56. Fitted in the frame are also the end of the suction pipe and the suction turbine. The suction inlet is provided with a limiter. The apparatus is inclined about the main shaft in the direction of motion through about 10–30° relative to the driving roller, so that the forward roller is milling while the rearward roller has a finishing function. The tilting is performed by the water hydraulic cylinders at the same time when the driving direction is changed. The direction of rotation of the feed rollers is not changed when the driving direction changes; instead, it remains the same regardless of the driving direction, only the inclination and the direction of the caterpillar drive are changed. The sludge is removed via the suction pipe.

The operating carriage may also be controlled electrically by means of an electronics unit, which may additionally be provided with e.g. a GPS positioning system for locating the operating carriage and directing it to the right direction of travel. The electric energy needed by the electronics etc. is produced by a water hydraulic generator included in the system. The apparatus can work even at a temperature below 0° C. when it is working under water, in which case it may be operated for long times, possibly round the year, e.g. under remote control or according to a predetermined program for a desired length of time, even under ice. The apparatus works independently of the depth of the lake and, being guided in vertical and horizontal directions by guide cables, it can pass over/under obstacles that can not be avoided using above-water guide equipment.

An extension can be connected to the discharge pipe during operation by using an extension float 11, the pipes and the joint are under water and the flow continues without interruption.

EXAMPLE 2

Figure 6:
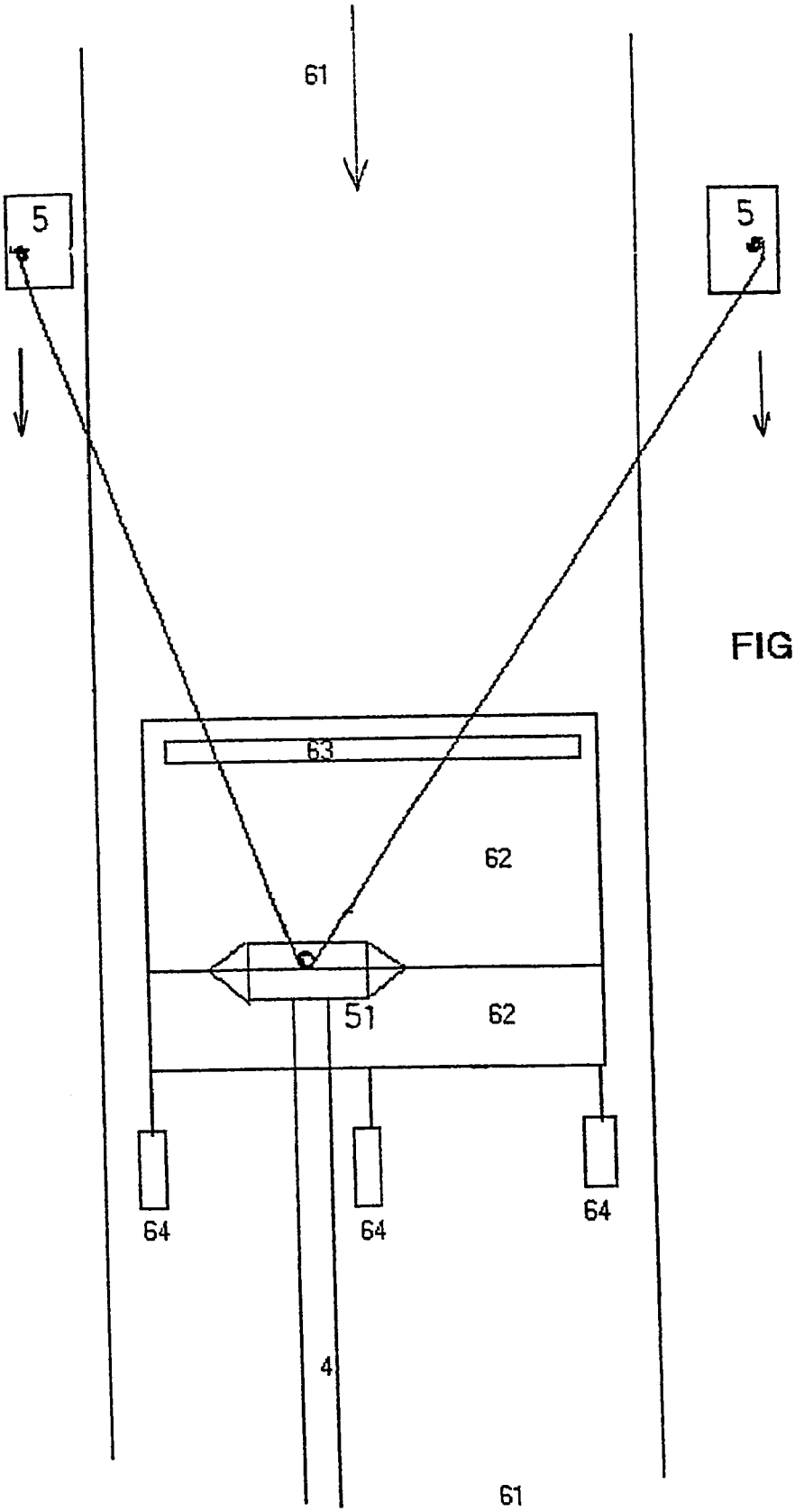
FIG. 6 presents another dredging apparatus according to the invention, moving on a river.

FIG. 6 illustrates the operation of the apparatus in the case of cleaning a flowing river 61 in the direction of flow (as seen from the bottom of the river). In this case, the apparatus is used with a protective apron 62 fitted on it to protect the dredging area from the current of the river during the work. The apron may consist of two parts, in which case the dredging apparatus opens and closes the two halves in a zipper-like fashion as it is moving in the transverse direction of the river. Placed on the upper edge of the apron are additional weights 63 pressing the apron against the bottom to prevent excessive funneling of water under the protective apron, thus minimizing undesirable by-pass flow of water in the dredging area. Placed at the lower edge are supporting elements 64, with the help of which the apron can move on when necessary without getting stuck on the bottom during work.

It is obvious to the person skilled in the art that different embodiments of the invention are not limited to the examples described above, but that they may be varied within the scope of the claims presented below.

The invention claimed is:

1. A method for cleaning a water area, comprising:

dredging, via a dredging apparatus, waste from the water area through a suction pipe into a sedimentation basin;

generating a flow in the suction pipe of the dredged waste from the water area to the sedimentation basin via siphonage and variations in heights of the suction pipe relative to a bottom of the water area; and converting energy caused by the flow of the dredged waste in the suction pipe into energy for driving the dredging apparatus.

2. The method according to claim 1, wherein the water area comprises a lake, a pond or a river.

3. The method according to claim 1, wherein the waste comprises sludge and/or humus.

4. The method according to claim 1, further comprising:

retarding a flow of the dredged waste from the suction pipe into the sedimentation basin such that as the dredged waste advances through the sedimentation basin, the dredged waste is separated via sedimentation in the sedimentation basin.

5. An apparatus for cleaning a water area, comprising:

a dredging apparatus configured to dredge waste from the water area;

a suction pipe connecting the dredging apparatus to a sedimentation basin, said dredged waste flowing in the suction pipe from the water area to the sedimentation basin via siphonage and variations in heights of the suction pipe relative to a bottom of the water area; and a flow converter configured to convert energy caused by the flow of the dredged waste in the suction pipe into energy for driving the dredging apparatus.

6. The apparatus according to claim 5, further comprising:

a propulsion system configured to propel the dredging apparatus and being arranged in connection with an input end of the suction pipe, wherein said propulsion system includes a coupling device configured to transmit motion of the flow converter rotating due to the flow of the waste to the dredging apparatus.

7. The apparatus according to claim 6, wherein the propulsion system includes wheels or rollers that are driven with the energy converted by the flow converter to propel the dredging system along the bottom of the water area.

8. The apparatus according to claim 5, wherein the dredging apparatus includes dredging or cleaning elements configured to dredge the waste from the water area.

9. The apparatus according to claim 8, wherein the dredging or cleaning elements rotate to dredge the waste from the water area.

10. The apparatus according to claim 5, comprising:

a floating operating carriage, on which the dredging apparatus is suspended by cables, so a load applied by the dredging apparatus to the bottom of the water area is accurately limited and kept constant; and a drive mechanism configured to move said carriage.

11. The apparatus according to claim 10, wherein the drive mechanism comprises control devices configured to control the carriage from a shore of the water area.

12. The apparatus according to claim 10, wherein the drive mechanism comprises an electronic control unit provided with a positioning system configured to control the carriage.

13. The apparatus according to claim 5, further comprising:

motion elements configured to set water in the water area into motion to keep an area in the water area in a liquid state.

14. The apparatus according to claim 5, further comprising:

an apron disposed in the water area and configured to prevent an area currently being dredged from a current occurring in the water area, said apron comprising weights used to prevent excessive funneling of water under the apron, and a suspension configured to suspend the apron in the water area.

15. The apparatus according to claim 5, further comprising:

a boom system disposed in the sedimentation basin and configured to disperse the waste dumped into the sedimentation basin.

16. The apparatus according to claim 5, wherein the sedimentation basin has a width substantially larger than a diameter of the suction pipe.

17. The apparatus according to claim 5, wherein the flow converter comprises a suction turbine.

18. The apparatus according to claim 5, wherein the water area comprises a lake, a pond or a river.

19. The apparatus according to claim 5, wherein the waste comprises sludge and/or humus.

20. The apparatus according to claim 5, further comprising:

a flow retarding mechanism configured to retard a flow of the dredged waste from the suction pipe into the sedimentation basin such that as the dredged waste advances through the sedimentation basin, the dredged waste is separated via sedimentation in the sedimentation basin.

* * * * *